US011965687B1

(12) United States Patent
Wu

(10) Patent No.: US 11,965,687 B1
(45) Date of Patent: Apr. 23, 2024

(54) ICE BALL MAKING BOX

(71) Applicant: Lina Wu, Zhejiang (CN)

(72) Inventor: Lina Wu, Zhejiang (CN)

( * ) Notice: Subject to any disclaimer, the term of this patent is extended or adjusted under 35 U.S.C. 154(b) by 0 days.

(21) Appl. No.: 18/398,006

(22) Filed: Dec. 27, 2023

(30) Foreign Application Priority Data

Jan. 7, 2023 (CN) ..... 202320039095.2

(51) Int. Cl.
*F25C 1/246* (2018.01)
*F25C 1/25* (2018.01)

(52) U.S. Cl.
CPC ..... *F25C 1/246* (2013.01); *F25C 1/25* (2018.01)

(58) Field of Classification Search
CPC ..... F25C 1/246; F25C 1/25
See application file for complete search history.

(56) References Cited

U.S. PATENT DOCUMENTS

| | | | |
|---|---|---|---|
| 11,808,507 | B2 | 11/2023 | Becker et al. |
| 2023/0184478 | A1 | 6/2023 | Chen et al. |
| 2023/0366603 | A1 | 11/2023 | Moczygemba et al. |

FOREIGN PATENT DOCUMENTS

| | | | |
|---|---|---|---|
| CN | 202895535 | U | 4/2013 |
| CN | 213955703 | U | 8/2021 |
| CN | 215490477 | U | 1/2022 |
| CN | 215909484 | U | 2/2022 |
| CN | 217827457 | U | 11/2022 |

*Primary Examiner* — James Sanders

(57) ABSTRACT

The present disclosure provides an ice ball making box, including a first ice-making layer, a second ice-making layer, a third ice-making layer, an ice storage layer and an ice ball mold. The ice ball mold includes first ice mold bodies, second ice mold bodies arranged in the first ice-making layer and third ice mold bodies arranged in the third ice-making layer in sequence. Press-demolding parts are arranged in the first ice-making layer. The first ice mold body, the second ice mold body and the third ice mold body together form a spherical ice ball mold cavity. Water is filled into the ice ball mold cavity from the first ice-making layer via a water inlet passage of the first ice mold body. The ice ball making box can simultaneously mold and release a plurality of ice balls by pressing and store them together in the ice storage layer.

20 Claims, 10 Drawing Sheets

ICE BALL MAKING BOX

CROSS REFERENCE TO RELATED APPLICATION

This application claims priority benefit of Chinese invention patent Application No. 202320039095.2, filed on Jan. 7, 2023, and the entire contents of which are incorporated herein by reference.

TECHNICAL FIELD

The present disclosure relates to freezing tools for everyday life, and particularly relates to an ice ball making box.

BACKGROUND

An ice ball is a spherical ice cube. Ice balls and ice cubes are the most common ice blocks in everyday life. However, compared with ice cubes, making and molding methods for ice balls are relatively complex with higher requirements for ice ball making and storage tools.

Demolding of ice blocks made by existing ice block making tools is usually performed in a pressing way. Compared with a conventional method for releasing each ice block separately, a one-step demolding method for simultaneously releasing ice blocks in a plurality of lattices is preferred. The method can refer to the patents such as CN213955703U or CN215490477U.

However, the above-mentioned tools for making such ice blocks can not be applied to spherical ball blocks, and other ice ball making tools in the prior art can not perform efficient, stable and synchronous molding, demolding and storage of multiple ice balls. An ice ball making principle in the prior art can refer to the patents: CN215909484U, CN217827457U and CN202895535U.

Therefore, the present disclosure will propose a solution to the above technical problem.

SUMMARY

The present disclosure aims to provide an ice ball making box, which can mold a plurality of ice balls in one step, efficiently and stably release them from a mold in a pressing way and then store them, thereby being complete in function, reasonable in structure and easy to use with less effort.

The goal of the present disclosure is achieved as follows: an ice ball making box comprises a first ice-making layer, a second ice-making layer, a third ice-making layer, an ice storage layer and an ice ball mold, the ice ball mold comprises first ice mold bodies located in the upper layer, second ice mold bodies located in the middle layer and third ice mold bodies located in the lower layer, press-demolding parts are arranged in the first ice-making layer, the second ice mold bodies are arranged in the second ice-making layer, the third ice mold bodies are arranged in the third ice-making layer, the first ice mold body, the second ice mold body and the third ice mold body together form a spherical ice ball mold cavity, and water is filled into the ice ball mold cavity from the first ice-making layer via a water inlet passage of the first ice mold body.

More specifically, a water filling trough is formed in the first ice-making layer, and a water filling hole is formed at the position corresponding to the water inlet passage of each first ice mold body in the water filling trough.

More specifically, a guide slope is formed around the periphery of the water filling hole, inclined toward the water filling hole.

More specifically, the water filling trough is divided into a plurality of water filling lattices by ribs, and the surfaces of the water filling lattices are inclined toward the water filling holes.

More specifically, a lid corresponding to the water filling trough is arranged on the first ice-making layer, and the lid is fixedly mounted on the first ice-making layer in a limiting buckled or articulated mode.

More specifically, an inspection window is formed in the first ice-making layer, and overflow holes are formed in the first ice mold bodies, located on one side close to the inspection window.

More specifically, a plurality of first drain holes are formed in the second ice-making layer.

More specifically, overflow holes are formed in the first ice mold bodies, located on one side close to the first drain holes.

More specifically, second drain holes are formed at the positions, corresponding to the first drain holes, of the third ice-making layer.

More specifically, the aperture of the second drain holes is greater than that of the first drain holes, and the first drain holes extend into the second drain holes.

More specifically, a return rebound structure is arranged between the first ice-making layer and the second ice-making layer.

More specifically, the return rebound structure comprises guide posts on the first ice-making layer and positioning tubes on the second ice-making layer, and return springs are placed in the positioning tubes.

More specifically, the first ice-making layer and the second ice-making layer are connected and fixed through a buckle connecting structure.

More specifically, the buckle connecting structure comprises buckles on the sidewall of the first ice-making layer and clamping grooves in the sidewall of the second ice-making layer.

More specifically, the bottom of the second ice-making layer and the top of the third ice-making layer are provided with corresponding limiting mounting structures, the second ice-making layer can be supported and placed on the third ice-making layer, the bottom of the second ice-making layer and the top of the ice storage layer are provided with corresponding limiting mounting structures, and the second ice-making layer can be supported and placed on the ice storage layer.

More specifically, a limiting mounting ring is formed at the bottom of the second ice-making layer, and a limiting placing groove corresponding to the limiting mounting ring is formed in the third ice-making layer.

More specifically, an inner sidewall of the ice storage layer is provided with limiting support ribs, and an outer sidewall of the ice storage layer is provided with a limiting support step, the bottom of the second ice-making layer is mounted and placed on the ice storage layer through the limiting support ribs, and the bottom of the third ice-making layer is mounted and placed on the ice storage layer through the limiting support step.

More specifically, a notch is formed in the limiting support rib, the limiting mounting ring is formed at the bottom of the second ice-making layer, and the limiting mounting ring is mounted on the limiting support ribs through the notches.

More specifically, the first ice mold body comprises a press wall wrapping the top of an ice ball, the press wall is made of a flexible material that can return to its original state after being pressed to deform, and the press wall is provided with an overflow hole.

More specifically, an ice ball freezing and hanging portion is formed on the sidewall of an inner circumference of the water inlet passage to block part of the water inlet passage.

More specifically, the press-demolding part is cylindrical and is sleeved on an outer peripheral side of the water inlet passage, and when the press-demolding part moves toward the ice ball mold cavity, a press-demolding portion at the bottom end of the press-demolding part abuts against the upper surface of the first ice mold body so that the first ice mold body can be squeezed to deform and release an ice ball.

More specifically, a press-bending portion is formed on the press-demolding part, and when the press-demolding part is pressed to move downwards, the press-bending portion at least partially touches the water inlet passage to bend the water inlet passage.

Compared with the prior art, the present disclosure has the beneficial technical effects:

the ice ball making box of the present disclosure is provided with the first ice-making layer, the second ice-making layer, the third ice-making layer, the ice storage layer and the ice ball mold and can simultaneously mold and release the plurality of ice balls by pressing and store them together in the ice storage layer, thereby being complete in function; and the ice ball making box is more stable, efficient and effort-saving through the arrangement of the structures such as the ice ball freezing and hanging portions, the press walls, the drain holes and the press-bending portions.

BRIEF DESCRIPTION OF THE DRAWINGS

The accompanying drawings, which constitute a part of this application, are used for providing a further understanding of the present disclosure; and schematic embodiments of the present disclosure and descriptions thereof are intended to explain the present disclosure and are not construed to unduly limit the present disclosure. The drawings are as follows.

DESCRIPTIONS OF THE DRAWING REFERENCE NUMBERS

Figure 1:
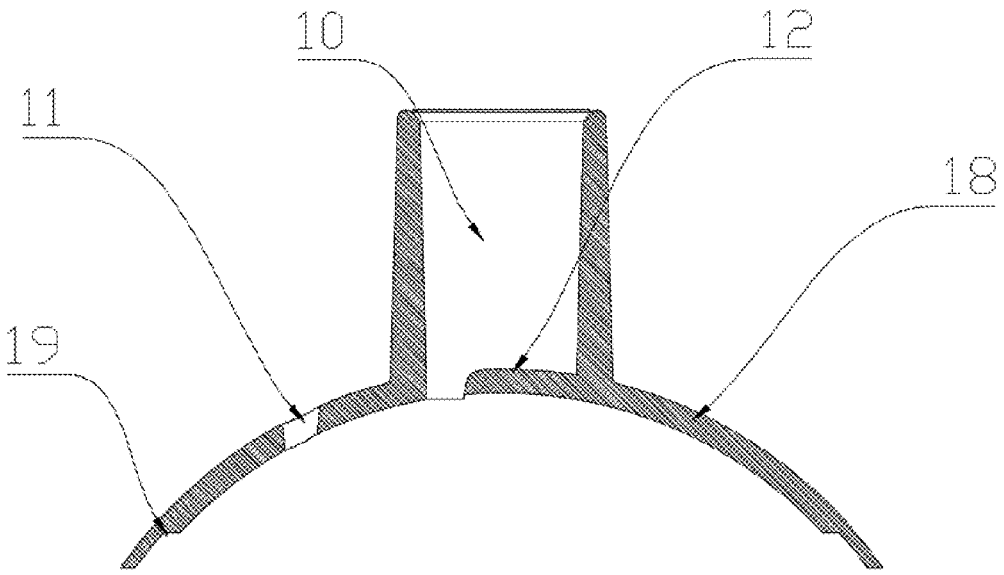
FIG. 1 is a sectional view of a first ice mold body according to the present disclosure.
Figure 2:
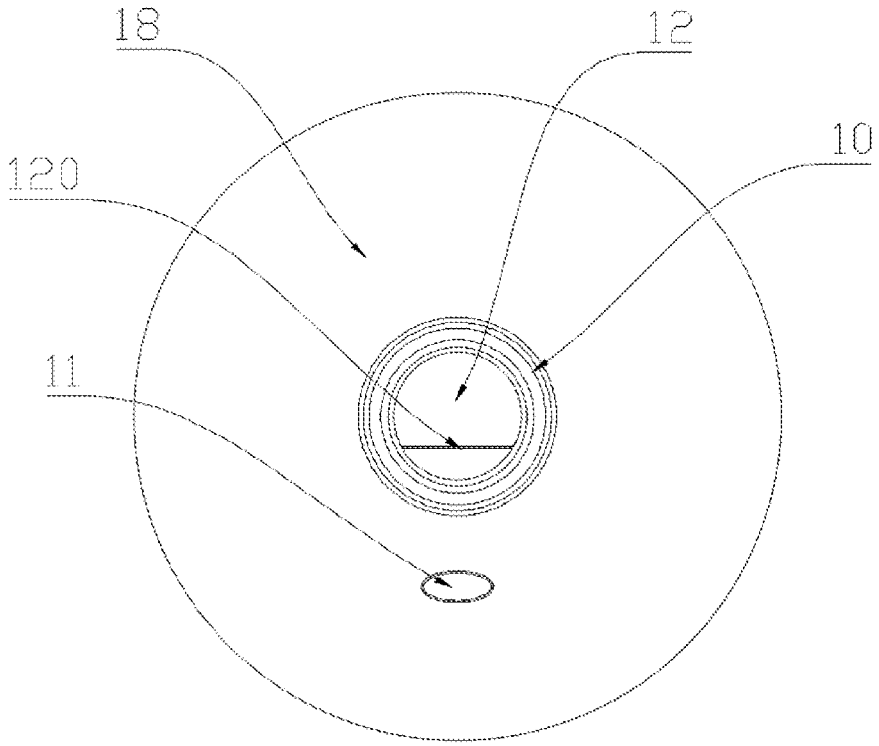
FIG. 2 is a top view of the first ice mold body according to the present disclosure.
Figure 3:
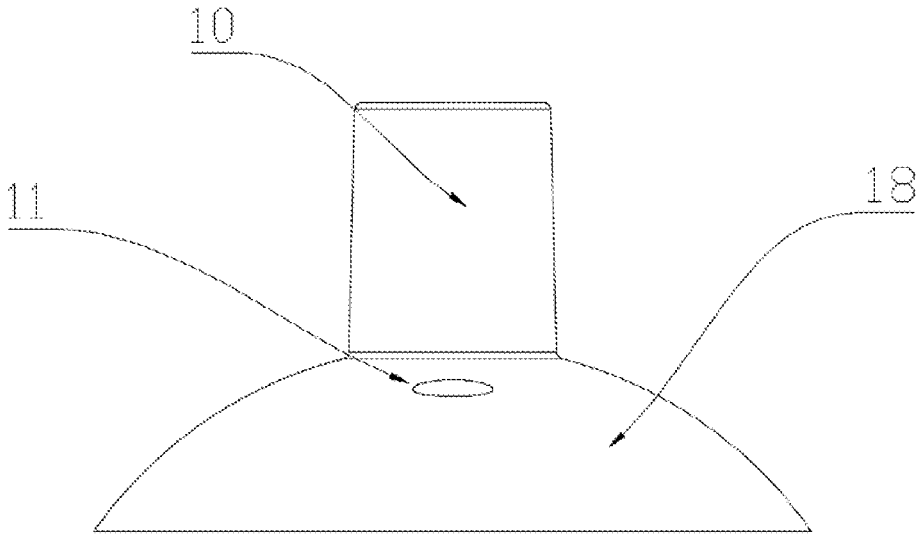
FIG. 3 is a front view of the first ice mold body according to the present disclosure.
Figure 4:
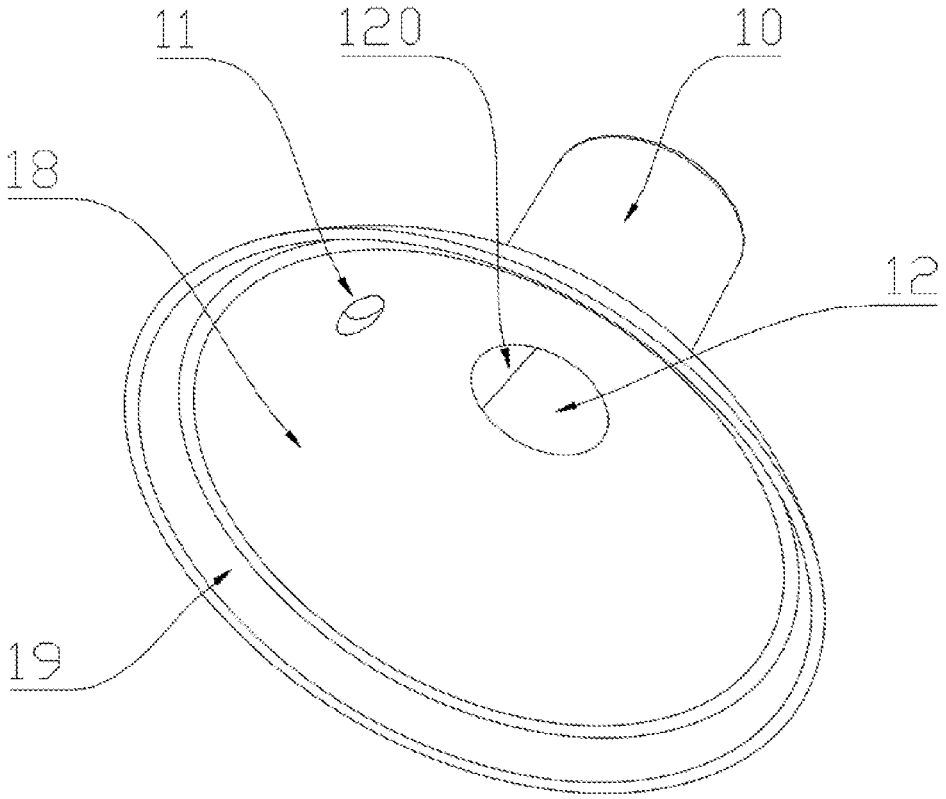
FIG. 4 is a first embodiment of a freezing and hanging eave according to the present disclosure.
Figure 5:
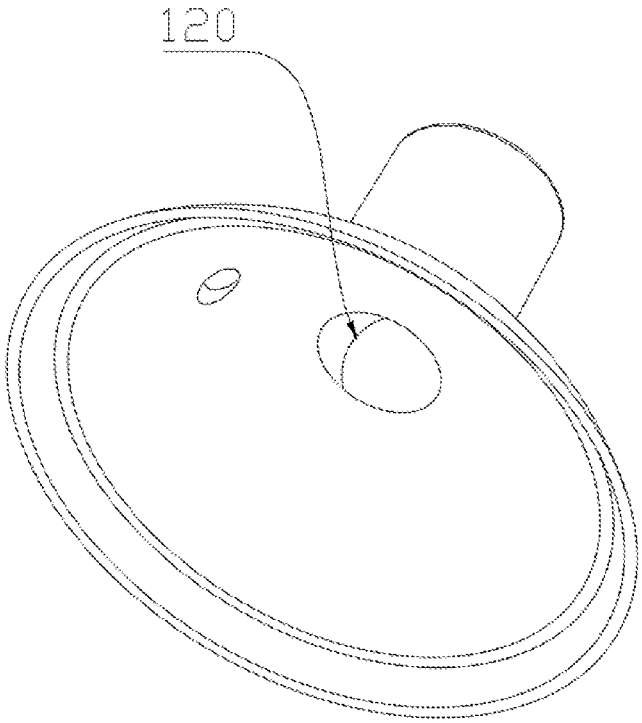
FIG. 5 is a second embodiment of the freezing and hanging eave according to the present disclosure.
Figure 6:
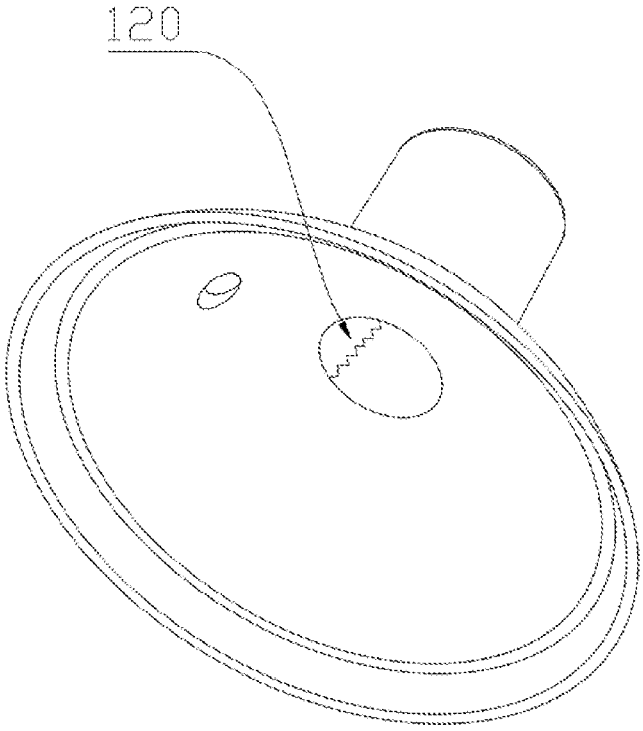
FIG. 6 is a third embodiment of the freezing and hanging eave according to the present disclosure.
Figure 7:
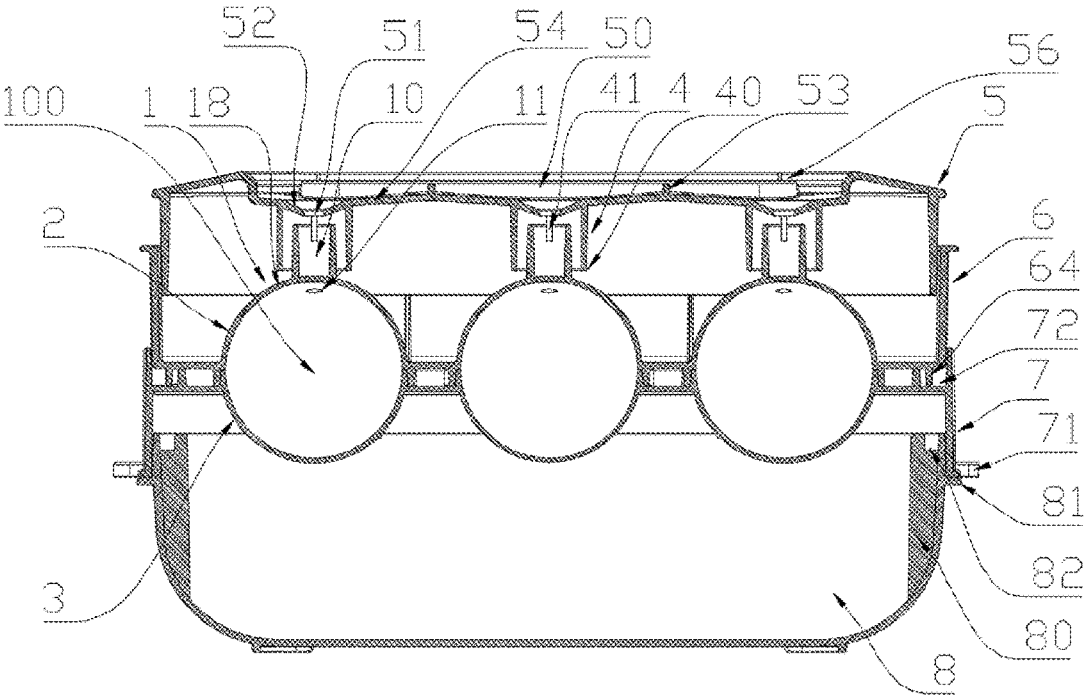
FIG. 7 is a sectional view of the ice ball making box according to the present disclosure.
Figure 8:
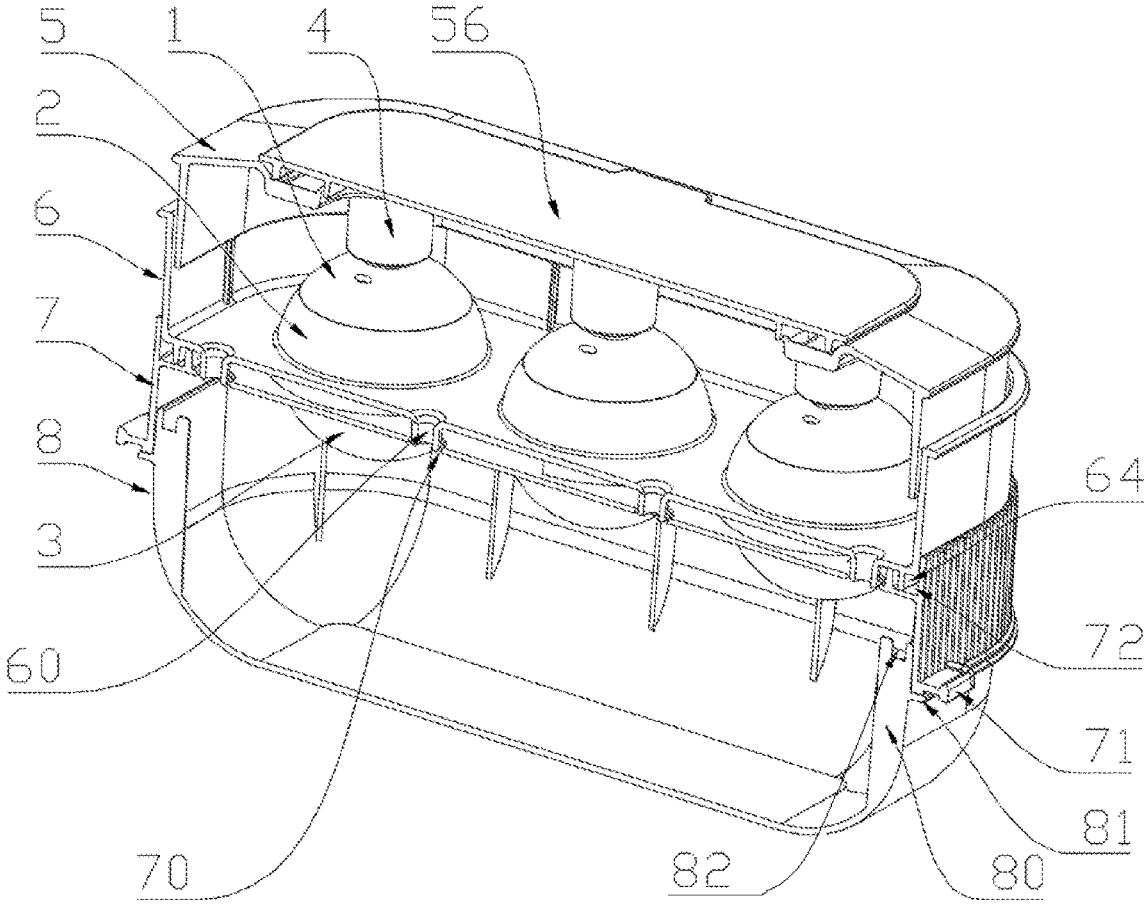
FIG. 8 is a sectional view II of the ice ball making box according to the present disclosure.

1—first ice mold body; 10—water inlet passage; 11—overflow hole; 12—ice ball freezing and hanging portion; 18—press wall; 19—assembly step;

2—second ice mold body;

3—third ice mold body;

4—press-demolding part; 40—press-demolding portion; 41—press-bending portion; 5—first ice-making layer; 50—water filling trough; 51—water filling hole; 52—guide slope; 53—rib; 54—water filling lattice; 55—inspection window; 56—lid; 6—second ice-making layer; 60—first drain hole; 61—positioning tube; 62—return spring; 63—clamping groove; 64—limiting mounting ring;

7—third ice-making layer; 70—second drain hole; 71—lifting handle; 72—limiting placing groove;

8—ice storage layer; 80—limiting support rib; 81—limiting support step; 82—notch;

100—ice ball mold cavity.

DETAILED DESCRIPTION OF EMBODIMENTS

The present disclosure will be described in detail below with reference to the accompanying drawings and embodiments. Each example is provided by way of an explanation of the present disclosure rather than limiting of the present disclosure. In fact, those skilled in the art will recognize that modifications and variations can be made in the present disclosure without departing from the scope or spirit of the invention. For example, features shown or described as part of one embodiment may be used in another embodiment to produce yet another embodiment. Therefore, it is intended that the present disclosure includes such modifications and variations as come within the scope of the appended claims and their equivalents.

As shown in FIG. 1 to FIG. 17, an ice ball making box is provided with a first ice-making layer 5, a second ice-making layer 6, a third ice-making layer 7, an ice storage layer 8 and an ice ball mold. The ice ball mold includes first ice mold bodies 1, second ice mold bodies 2, third ice mold bodies 3 and press-demolding parts 4.

Figure 9:
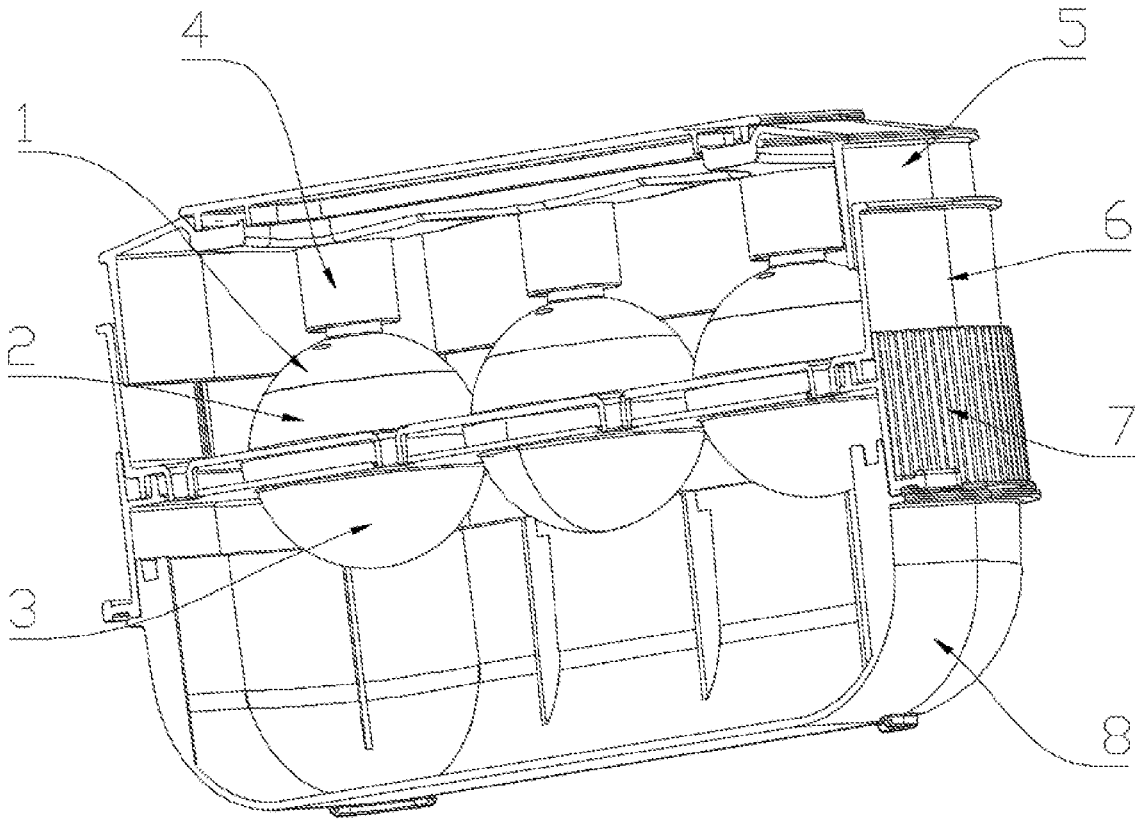
FIG. 9 is a sectional view III of the ice ball making box according to the present disclosure.
Figure 10:
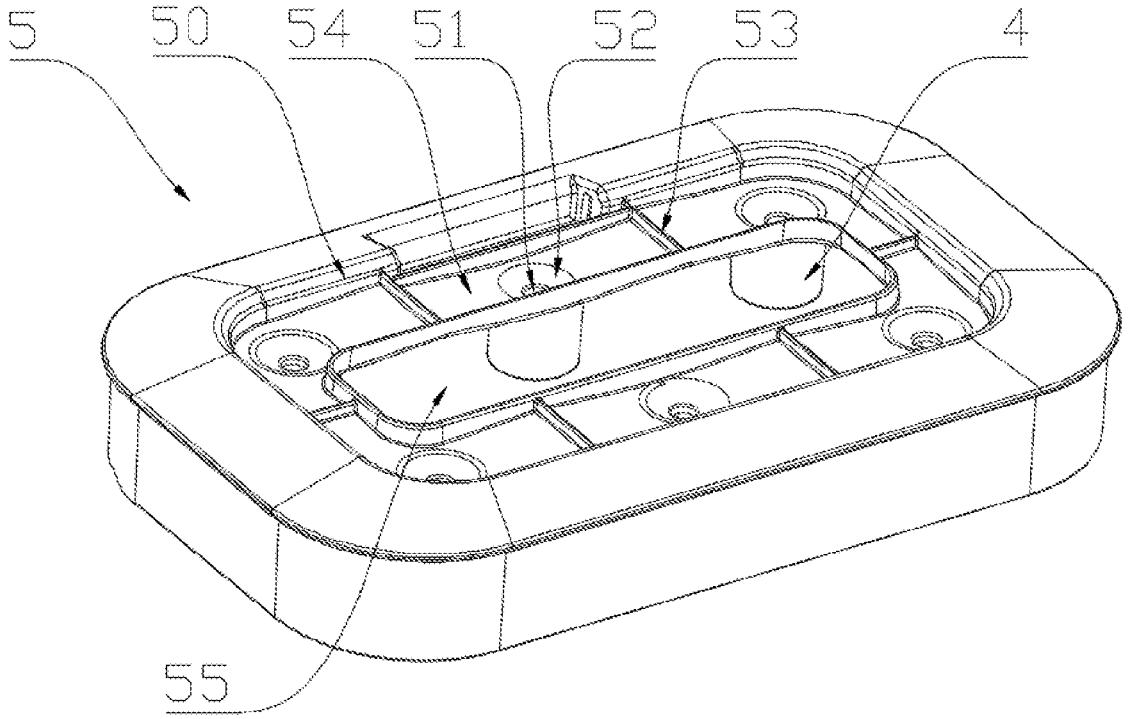
FIG. 10 is a schematic view of a first ice-making layer according to the present disclosure.
Figure 11:
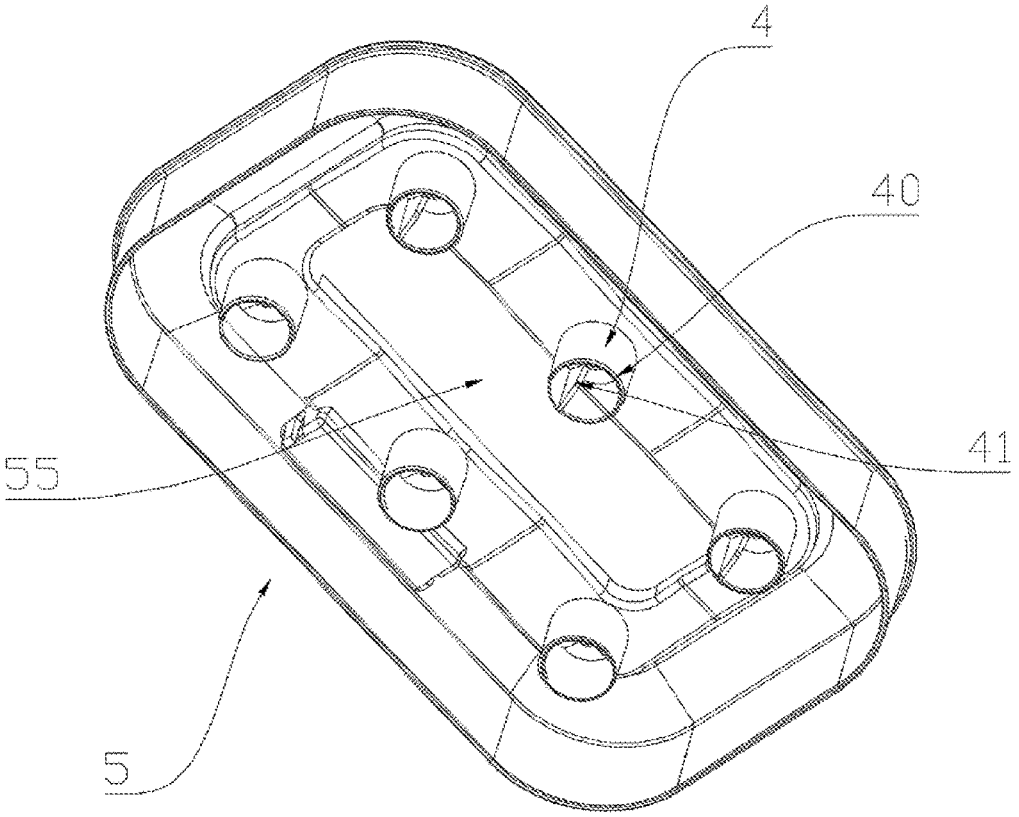
FIG. 11 is a schematic view II of the first ice-making layer according to the present disclosure.
Figure 12:
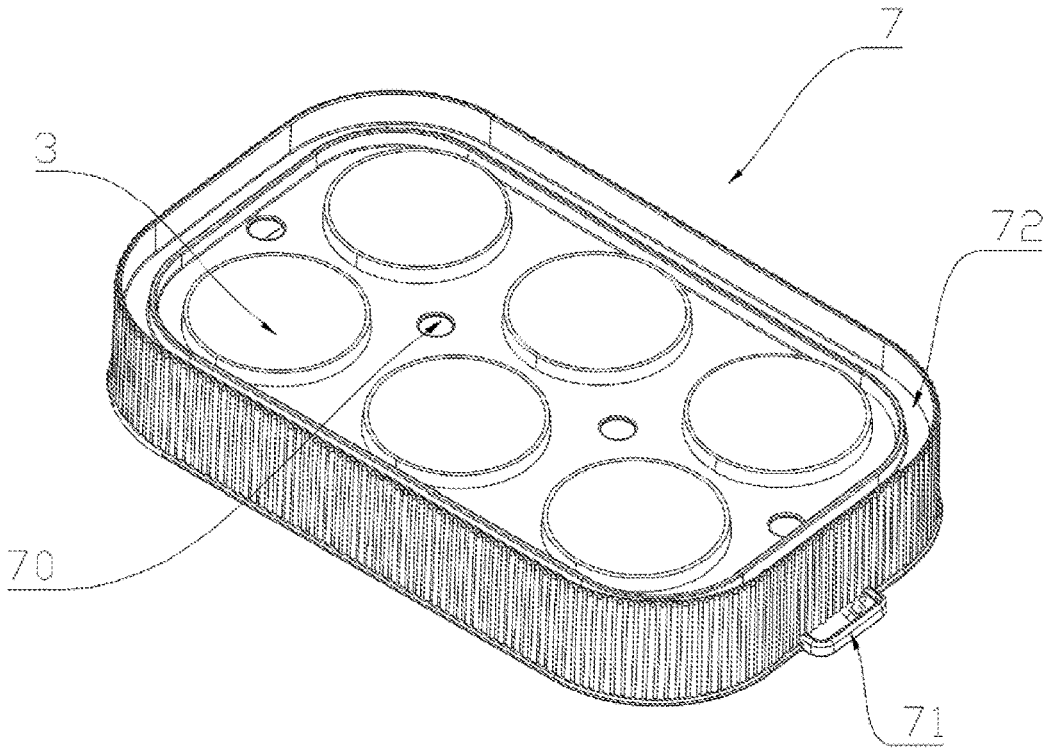
FIG. 12 is a schematic view of a third ice-making layer according to the present disclosure.
Figure 13:
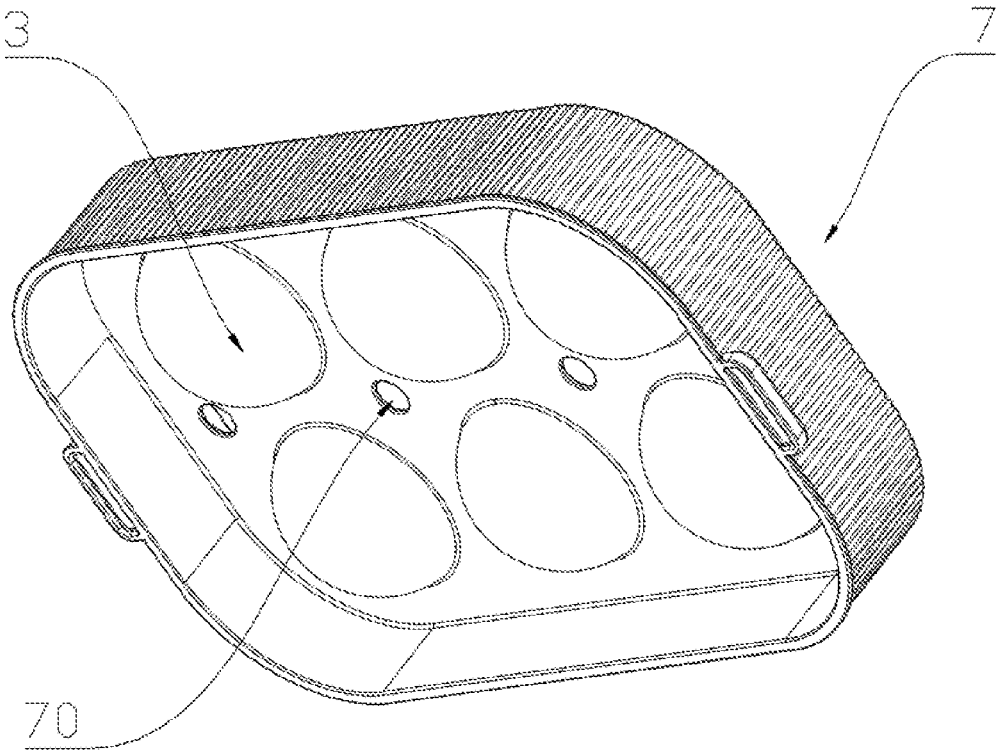
FIG. 13 is a schematic view II of the third ice-making layer according to the present disclosure.
Figure 14:
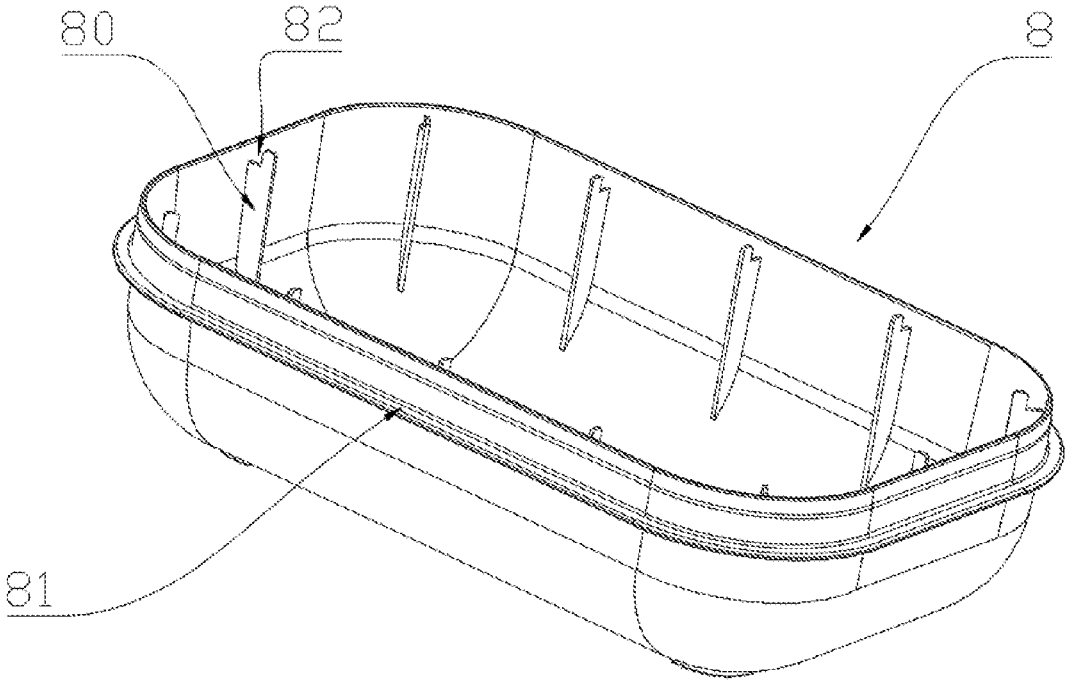
FIG. 14 is a structural schematic view of an ice storage layer according to the present disclosure.
Figure 16:
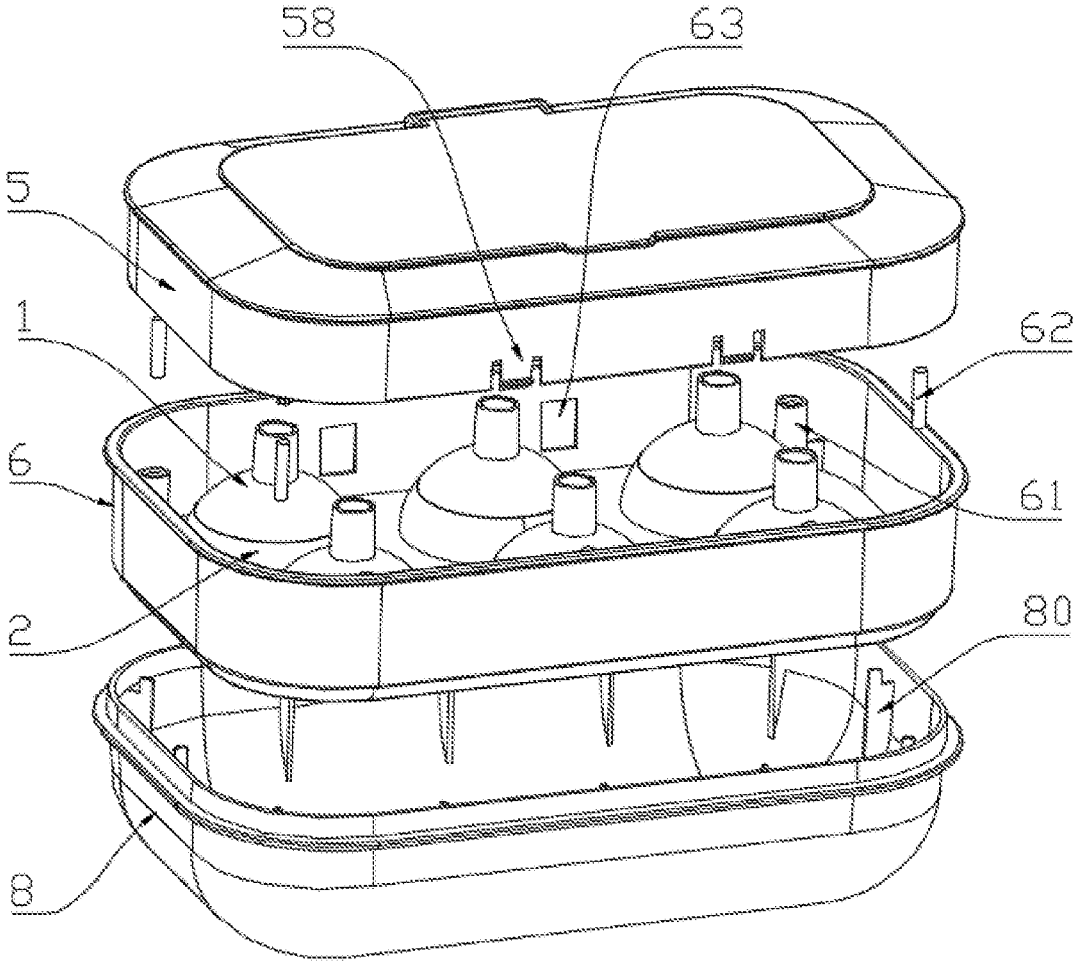
FIG. 16 is an exploded structural schematic view II of the ice ball making box according to the present disclosure.
Figure 17:
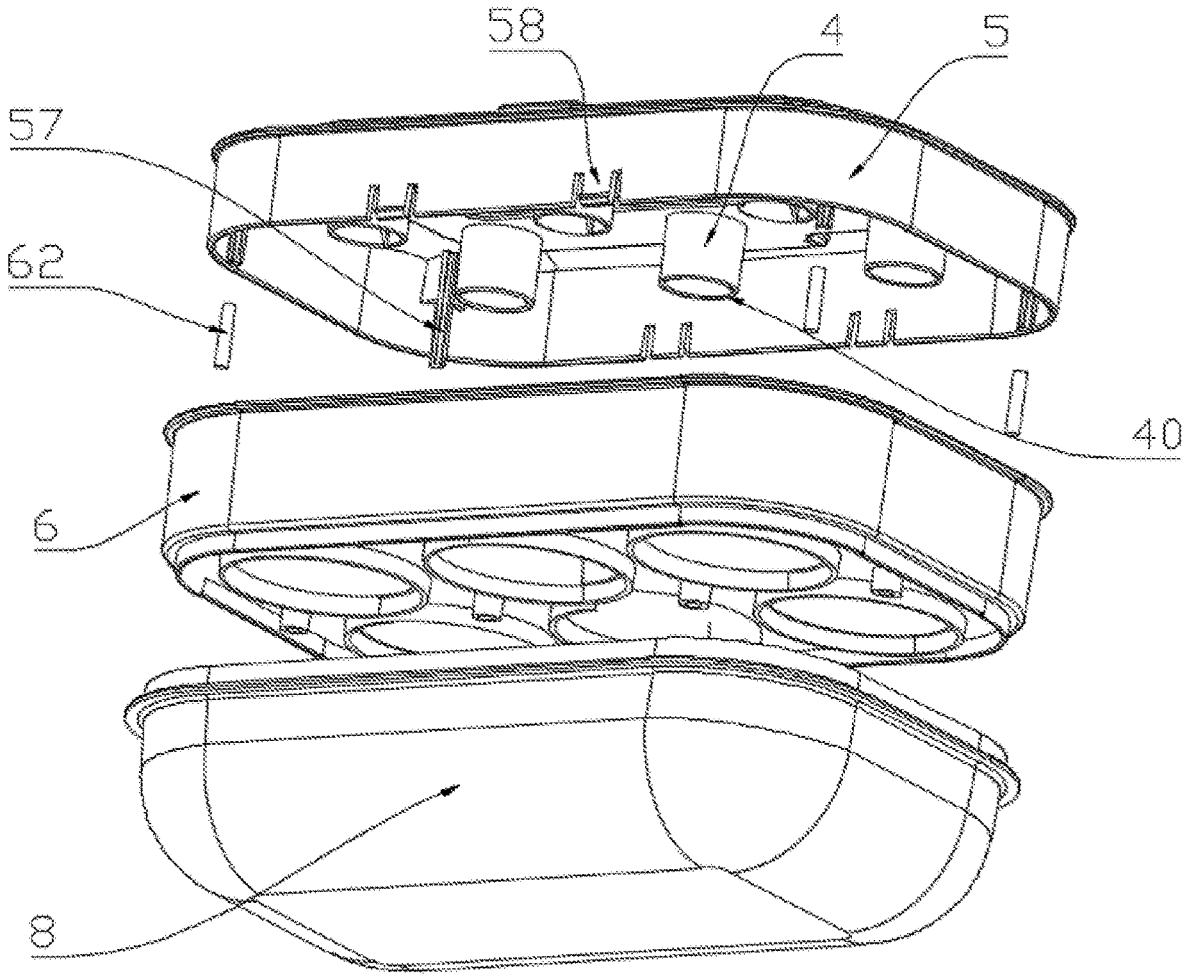
FIG. 17 is an exploded structural schematic view III of the ice ball making box according to the present disclosure.

Application principle: see FIG. 9 for the ice block molding process, water is filled into ice ball mold cavities 100 of the ice ball mold from the first ice-making layer 5; after water is frozen completely in the ice ball mold cavities 100, take down the third ice-making layer 7, place the first ice-making layer 5 and the second ice-making layer 6 together on the ice storage layer 8; see FIG. 16 and FIG. 17, while taking down the third ice mold bodies 3 on the third ice-making layer 7, the ice ball mold cavities 100 are directly communicated with storage spaces of the ice storage layer 8, at the time, the first ice-making layer 5 is pressed so that the press-demolding parts 4 press the first ice mold bodies 1 to enable ice balls to fall into the ice storage layer 8 from the ice ball mold cavities 100.

Specifically, the first ice mold body 1 of the mold includes a water inlet passage 10 and a press wall 18 wrapping the top of an ice ball; the water inlet passage 10 and the press wall 18 are made of a flexible material that can return to its original state after being pressed to deform, and the press wall 18 is provided with an overflow hole 11. In the technical solution, the shape and structure of the first ice mold body 1 can refer to FIG. 1 to FIG. 6, the first ice mold body 1 acts on an upper half portion of an ice ball body, especially the top, the water inlet passage 10 allows water to be filled to the ice ball mold cavity 100, and the press wall 18 can be externally pressed to force an ice ball in the ice ball mold cavity 100 to get away from the ice ball mold; the edge of the lower surface of the press wall 18 is provided with a circle of assembly step 19 to be assembled with the second ice mold body 2; the water inlet passage 10 and the press wall 18 can be made of a flexible material such as silica gel or rubber and can deform and return to its original state; the overflow hole 11 allows the excess water that is filled to spill out of the ice ball mold cavity 100, the overflow hole 11, formed in the press wall 18, maintains a certain height difference with the bottommost end of the water inlet passage 10 to prevent excess ice blocks from going into the water inlet passage 10 due to volume expansion in the water freezing process; the overflow hole 11 is an elliptic hole with a short axis pointing to the water inlet passage 10; and compared with a perfect circular overflow hole, the overflow efficiency of the elliptic overflow hole 11 is higher under the same hole area.

Specifically, an ice ball freezing and hanging portion 12 is formed on the sidewall of an inner circumference of the water inlet passage 10 to block part of the water inlet passage 10. The ice ball freezing and hanging portion 12 is shaped like a baffle or a step, located at the bottommost end of the water inlet passage 10. The ice ball freezing and hanging portion 12 at least blocks more than half of the water inlet passage 10. The ice ball freezing and hanging portion 12 is provided with a freezing and hanging eave 120 which is straight, arc-shaped or serrated. In the technical solution, the ice ball freezing and hanging portion 12 is formed as some water flows into the water inlet passage 10 to form an ice pillar in the water freezing and expansion process, and the ice pillar can be hung to the first ice mold body 1 through the ice ball freezing and hanging portion 12, so the whole ice ball can not fall off after taking down the third ice mold body 3 on the third ice-making layer 7 and can be completely and smoothly placed on the ice storage layer 8 along with the first ice-making layer 5 and the second ice-making layer 6, thereby releasing the ice ball more stably and preventing the ice ball from dropping and being contaminated as it is moved; the shape and the arrangement mode of the ice ball freezing and hanging portion 12 can refer to FIG. 1 and FIG. 2, the ice ball freezing and hanging portion 12, shaped like a baffle or a step, blocks the water inlet passage 10, water flows over the baffle-like or step-like ice ball freezing and hanging portion 12 and then can be frozen and hung securely, and in the demolding process, the straight, arc-shaped or serrated freezing and hanging eave 120 can more easily break off an unnecessary ice pillar body formed as the ice ball gets frozen; and various embodiments of the freezing and hanging eave 120 can refer to FIG. 4, FIG. 5 and FIG. 6 in the drawings.

Specifically, the sidewall of the water inlet passage 10 is an upper thin and lower thick structure. In the technical solution, the upper thin and lower thick water inlet passage 10 can refer to FIG. 1. The sidewall of an upper portion of a passage opening is thin, and the sidewall of a lower portion of the passage opening is thick. When the unnecessary ice pillar needs to be broken off by bending, the water inlet passage 10 can return to its original state more easily. Thus, it is a structure that is more in line with the application principle of the ice ball mold.

Specifically, ice balls in the ice ball mold are released through the press-demolding parts 4. As the press-demolding parts 4 moves toward the ice ball mold cavities 100, the press-demolding portions 40 at the bottom ends of the press-demolding parts abuts against the upper surfaces of the press walls 18 of the first ice mold bodies 1 and can squeeze the first ice mold bodies 1 to deform to release the ice balls. In the technical solution, the press-demolding portion 40 is a portion abutting against the press wall 18, including an abutting surface and an abutting point. This can refer to a circular surface in FIG. 11. See FIG. 11, the press-demolding part 4 is cylindrical and can be sleeved on an outer peripheral side of the water inlet passage 10.

Specifically, a press-bending portion 41 is formed on the press-demolding part 4. When the press-demolding part 4 is pressed to move downwards, the press-bending portion 41 at least partially touches the water inlet passage 10 to bend the water inlet passage 10, and the press-bending portion 41 is in an upper wide and lower narrow structure; in the technical solution, the press-bending portion 41 squeezes the water inlet passage 10 to enable an ice pillar body therein to get broken off at the ice ball freezing and hanging portion 12 as the press-demolding part 4 is pressed to move downwards to perform demolding, thereby enabling the demolding process to be easier and more effort-saving and the steps to be more simplified; the shape of the press-bending portion 41 can refer to FIG. 11, a wide portion of the press-bending portion 41 has a higher pressure to the water inlet passage 10, and the upper wide and lower narrow structure can be in conjunction with the upper thin and lower thick structure of the sidewall of the water inlet passage 10 to enable the press-demolding part to be pressed more easily with less effort.

Specifically, the first ice-making layer 5 is provided with a water filling trough 50, a water filling hole 51 is formed at the position corresponding to the water inlet passage 10 of each first ice mold body in the water filling trough 50, and a guide slope 52 is formed around the periphery of the water filling hole 51, inclined toward the water filling hole 51; the water filling trough 50 is divided into a plurality of water filling lattices 54 by ribs 53, and the surfaces of the water filling lattices 54 are inclined toward the water filling holes 51. In the technical solution, the water filling trough 50, the water filling holes 51, the guide slopes 52 and the water filling lattices 54 have the effect of allowing water to be accurately and rapidly filled into the ice ball mold cavities 100. It's worth noting that when the inclined angle of the guide slopes 52 is the same as that of the water filling lattices 54, and both may be visually in the same plane. However, it should be still noted that the existence of the guide slopes 52 and the water filling lattices 54 inclined toward the water filling holes 51 falls within the scope of protection of the technical solution.

Specifically, a lid 56 corresponding to the water filling trough 50 is arranged on the first ice-making layer 5, and the lid 56 is fixedly mounted on the first ice-making layer 5 in a limiting buckled or articulated mode. In the technical solution, the lid 56 is used for covering the water filling trough 50 to keep the water filled into the ice ball mold cavities 100 clean.

Figure 15:
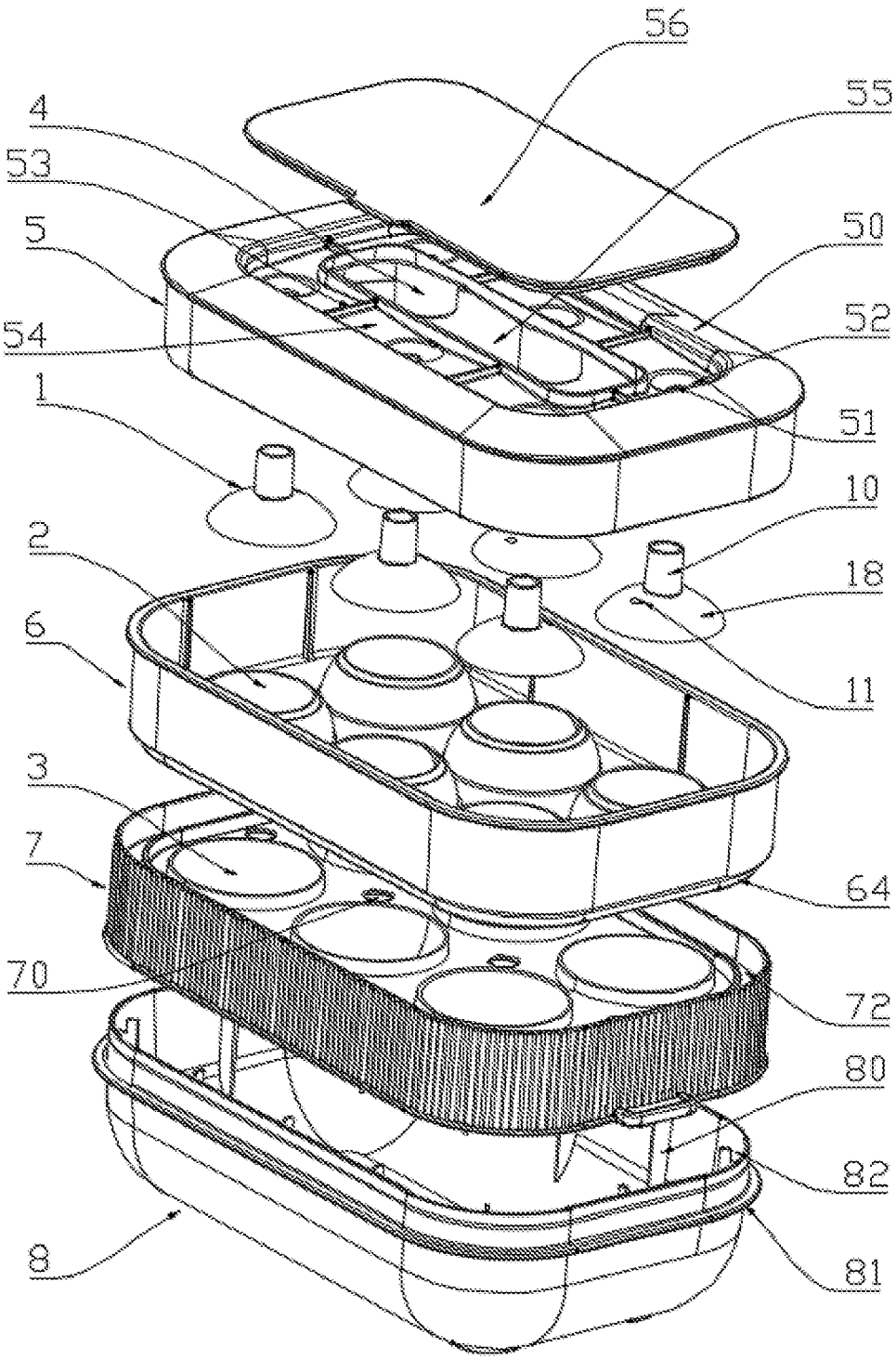
FIG. 15 is an exploded structural schematic view of the ice ball making box according to the present disclosure.

Specifically, an inspection window 55 is formed in the first ice-making layer 5, an overflow hole 11 is formed in the first ice mold body 1, and the overflow holes 11 are all formed on one side close to the inspection window 55. In the technical solution, the inspection window 55 is used to inspect whether the ice ball mold cavities 100 are filled with water and water spills out of the overflow holes 11. The inspection window 55 may be structurally a hollowed-out window hole which can be a transparent glass plate; correspondingly, to see the positions of the overflow holes 11 visually and easily through the inspection window 55, the overflow holes 11 are formed on one side, close to the inspection window 55, of the first ice mold bodies 1. Referring to FIG. 15, the overflow holes 11 can be seen easily through the inspection window 55.

Specifically, a plurality of first drain holes 60 are formed in the second ice-making layer 6. The overflow holes 11 are formed in the first ice mold bodies 1, located on one side close to the first drain holes 60. Second drain holes 70 are formed at the positions, corresponding to the first drain holes 60, of the third ice-making layer 7. The aperture of the second drain hole 70 is greater than that of the first drain hole 60, and the first drain hole 60 extends into the second drain holes 70. In the technical solution, see FIG. 8, the excess water that is filled into the ice ball mold cavities 100 can be drained through the first drain holes 60 and the second drain holes 70. The first drain hole 60 extends into the second drain hole 70 or the second drain hole 70 extends into the first drain hole 60. To achieve a smoother draining effect, the overflow holes 11 are formed on one side, close to the first drain holes 60 and the second drain holes 70, of the first ice mold bodies 1, thereby allowing the spilled water to more easily flow to the first drain holes 60 and the second drain holes 70.

Specifically, a return rebound structure is arranged between the first ice-making layer 5 and the second ice-making layer 6, including guide posts 57 on the first ice-making layer 5 and positioning tubes 61 on the second ice-making layer 6, and return springs 62 are placed in the positioning tubes 61. In the technical solution, see FIG. 16 and FIG. 17, when the first ice-making layer 5 is pressed to release ice balls, the guide posts 57 of the first ice-making layer 5 rebound and return to its original state through the return springs 62, and therefore, a user can use the ice ball making box more conveniently with less effort.

Specifically, the first ice-making layer 5 and the second ice-making layer 6 are connected and fixed through a buckle connecting structure, including buckles 58 on the sidewall of the first ice-making layer 5 and clamping grooves 63 in the sidewall of the second ice-making layer 6. In the technical solution, the first ice-making layer 5 and the second ice-making layer 6 can be moved simultaneously through the buckle connecting structure.

Specifically, the bottom of the second ice-making layer 6 and the top of the third ice-making layer 7 are provided with corresponding limiting mounting structures, the second ice-making layer 6 can be supported and placed on the third ice-making layer 7, the bottom of the second ice-making layer 6 and the top of the ice storage layer 8 are provided with corresponding limiting mounting structures, and the second ice-making layer 6 can be supported and placed on the ice storage layer 8; a limiting mounting ring 64 is formed at the bottom of the second ice-making layer 6, and a limiting placing groove 72 corresponding to the limiting mounting ring 64 is formed in the third ice-making layer 7; an inner sidewall of the ice storage layer 8 is provided with limiting support ribs 80, and an outer sidewall of the ice storage layer 8 is provided with a limiting support step 81, the bottom of the second ice-making layer 6 is mounted and placed on the ice storage layer 8 through the limiting support ribs 80, and the bottom of the third ice-making layer 7 is mounted and placed on the ice storage layer 8 through the limiting support step 81; a notch 82 is formed in the limiting support rib 80, the limiting mounting ring 64 is formed at the bottom of the second ice-making layer 6, and the limiting mounting ring 64 is mounted on the limiting support ribs 80 through the notches 82.

The foregoing is merely a preferred embodiment of the present disclosure and is not intended to limit the scope of protection of the present disclosure. Thus, all the equivalent variations based on the structures, shapes and principles of the present disclosure should be covered by the scope of the protection of the present disclosure. The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. An ice ball making box, comprising: a first ice-making layer, a second ice-making layer, a third ice-making layer, an ice storage layer and an ice ball mold, the ice ball mold comprising first ice mold bodies located in an upper layer, second ice mold bodies located in a middle layer and third ice mold bodies located in a lower layer, press-demolding parts being arranged in the first ice-making layer, the second ice mold bodies being arranged in the second ice-making layer, the third ice mold bodies being arranged in the third ice-making layer, the first ice mold body, the second ice mold body and the third ice mold body together forming a spherical ice ball mold cavity, and water being filled into the ice ball mold cavity from the first ice-making layer via a water inlet passage of the first ice mold body.

2. The ice ball making box according to claim 1, wherein a water filling trough is formed in the first ice-making layer, and a water filling hole is formed at the position corresponding to the water inlet passage of each first ice mold body in the water filling trough.

3. The ice ball making box according to claim 2, wherein a guide slope is formed around the periphery of the water filling hole, inclined toward the water filling hole.

4. The ice ball making box according to claim 2, wherein the water filling trough is divided into a plurality of water filling lattices by ribs, and the surfaces of the water filling lattices are inclined toward the water filling holes.

5. The ice ball making box according to claim 2, wherein a lid corresponding to the water filling trough is arranged on the first ice-making layer, and the lid is fixedly mounted on the first ice-making layer in a limiting buckled or articulated mode.

6. The ice ball making box according to claim 1, wherein an inspection window is formed in the first ice-making layer, and overflow holes are formed in the first ice mold bodies, located on one side close to the inspection window.

7. The ice ball making box according to claim 1, wherein a plurality of first drain holes are formed in the second ice-making layer.

8. The ice ball making box according to claim 7, wherein overflow holes are formed in the first ice mold bodies, located on one side close to the first drain holes.

9. The ice ball making box according to claim 7, wherein second drain holes are formed at the positions, corresponding to the first drain holes, of the third ice-making layer;

the aperture size of the second drain holes is greater than that of the first drain holes, and the first drain holes extend into the second drain holes.

10. The ice ball making box according to claim 1, wherein a return rebound structure is arranged between the first ice-making layer and the second ice-making layer.

11. The ice ball making box according to claim 10, wherein the return rebound structure comprises guide posts on the first ice-making layer and positioning tubes on the second ice-making layer, and return springs are placed in the positioning tubes.

12. The ice ball making box according to claim 1, wherein the first ice-making layer and the second ice-making layer are connected and fixed through a buckle connecting structure;

the buckle connecting structure comprises buckles on the sidewall of the first ice-making layer and clamping grooves in the sidewall of the second ice-making layer.

13. The ice ball making box according to claim 1, wherein the bottom of the second ice-making layer and the top of the third ice-making layer are provided with corresponding limiting mounting structures, the second ice-making layer can be supported and placed on the third ice-making layer, the bottom of the second ice-making layer and the top of the ice storage layer are provided with corresponding limiting mounting structures, and the second ice-making layer can be supported and placed on the ice storage layer.

14. The ice ball making box according to claim 1, wherein a limiting mounting ring is formed at the bottom of the second ice-making layer, and a limiting placing groove corresponding to the limiting mounting ring is formed in the third ice-making layer.

15. The ice ball making box according to claim 1, wherein an inner sidewall of the ice storage layer is provided with limiting support ribs, and an outer sidewall of the ice storage layer is provided with a limiting support step, the bottom of the second ice-making layer is mounted and placed on the ice storage layer through the limiting support ribs, and the bottom of the third ice-making layer is mounted and placed on the ice storage layer through the limiting support step.

16. The ice ball making box according to claim 15, wherein a notch is formed in the limiting support rib, a limiting mounting ring is formed at the bottom of the second ice-making layer, and the limiting mounting ring is mounted on the limiting support ribs through the notch.

17. The ice ball making box according to claim 1, wherein the first ice mold body comprises a press wall wrapping the top of an ice ball, the press wall is made of a flexible material that can return to its original state after being pressed to deform, and the press wall is provided with an overflow hole.

18. The ice ball making box according to claim 17, wherein an ice ball freezing and hanging portion is formed on the sidewall of an inner circumference of the water inlet passage to block part of the water inlet passage.

19. The ice ball making box according to claim 1, wherein the press-demolding part is cylindrical and is sleeved on an outer peripheral side of the water inlet passage, and when the press-demolding part moves toward the ice ball mold cavity, a press-demolding portion at the bottom end of the press-demolding part abuts against the upper surface of the first ice mold body so that the first ice mold body can be squeezed to deform and release the ice ball.

20. The ice ball making box according to claim 19, wherein a press-bending portion is formed on the press-demolding part, and when the press-demolding part is pressed to move downwards, the press-bending portion at least partially touches the water inlet passage to bend the water inlet passage.

* * * * *